US008286273B1

(12) United States Patent
Toomer

(10) Patent No.: US 8,286,273 B1
(45) Date of Patent: Oct. 16, 2012

(54) TOILET FOOT FLUSHING APPARATUS

(76) Inventor: Cory M. Toomer, Coral Springs, FL (US)

( * ) Notice: Subject to any disclaimer, the term of this patent is extended or adjusted under 35 U.S.C. 154(b) by 478 days.

(21) Appl. No.: 12/555,929

(22) Filed: Sep. 9, 2009

(51) Int. Cl.
*E03D 5/00* (2006.01)

(52) U.S. Cl. ..... 4/249; 4/246.1; 4/246.2; 4/246.3; 4/246.4; 4/246.5; 242/389; 242/396.4

(58) Field of Classification Search ..... 4/249, 246.1, 4/246.2, 246.3, 246.4, 246.5
See application file for complete search history.

(56) References Cited

U.S. PATENT DOCUMENTS

| | | | | |
|---|---|---|---|---|
| 2,679,651 | A | 6/1954 | Pokorny | |
| 3,883,904 | A | 5/1975 | Wittman | |
| 4,649,576 | A * | 3/1987 | Lillie | 4/246.5 |
| 5,170,513 | A * | 12/1992 | Ambooken et al. | 4/249 |
| 6,718,562 | B1 | 4/2004 | Saragas | |
| D490,883 | S | 6/2004 | DePriest | |
| 7,003,815 | B2 * | 2/2006 | Herbst | 4/246.2 |
| 2007/0000036 | A1 * | 1/2007 | Jung | 4/246.1 |

* cited by examiner

*Primary Examiner* — Gregory Huson
*Assistant Examiner* — Lauren Heitzer

(57) ABSTRACT

The toilet foot flushing apparatus quickly converts a hand-flushed toilet to a foot-flushed toilet, without the need of tools. The included lever of the apparatus replaces the existing toilet lever, by hand. The pedal is about 1 foot in length, thereby providing sufficient leverage to the lever via the cable. The lever is attached to flush mechanism on the exterior of an existing toilet reservoir. The spring-loaded pedal returns to a position slightly above the base when released, thereby releasing lever pressure. The geared pedal to base action provides sturdy long-lived flush function. The apparatus does not require any form of floor invasion, as the base need not be mounted to the floor. The cable retainer provides length adjustment for the cable so that a plurality of toilet reservoirs and flush mechanisms can be successfully converted to foot flush.

4 Claims, 3 Drawing Sheets

TOILET FOOT FLUSHING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various devices are available for converting a hand flush toilet into a toilet flushed by a user's foot. Several problems exist with the currently available devices. Among those problems are insufficient leverage, lack of structural integrity, difficulty in mounting to a toilet, and floor mounting difficulties. The present toilet foot flushing apparatus overcomes these problems and more.

FIELD OF THE INVENTION

The toilet foot flushing apparatus relates to toilet flushing devices and more especially to a foot flushing apparatus that converts a previously hand operated toilet flush to a foot flushed toilet.

SUMMARY OF THE INVENTION

The general purpose of the toilet foot flushing apparatus, described subsequently in greater detail, is to provide a toilet foot flushing apparatus which has many novel features that result in an improved toilet foot flushing apparatus which is not anticipated, rendered obvious, suggested, or even implied by prior art, either alone or in combination thereof.

To attain this, the toilet foot flushing apparatus quickly converts a hand-flushed toilet to a foot-flushed toilet, without the need of tools. The apparatus partially comprises the base with pedal atop, the replacement flush mechanism lever, and the cable connecting the base to the lever. The included lever of the apparatus replaces the existing lever of the toilet, by hand. The pedal of the apparatus is importantly about 1 foot in length, thereby providing sufficient leverage to the lever via the cable. The lever is attached to flush mechanism on the exterior of an existing toilet reservoir. The pedal and lever provide for easy foot action. The spring-loaded pedal returns to a position slightly above the base when released, thereby releasing lever pressure. The geared pedal-to-base action provides sturdy long-lived flush function. The apparatus does not require any form of floor invasion, as the base need not be mounted to the floor. The cable retainer provides length adjustment for the cable so that a plurality of toilet reservoirs and flush mechanisms can be successfully converted to foot flush.

Thus has been broadly outlined the more important features of the improved toilet foot flushing apparatus so that the detailed description thereof that follows may be better understood and in order that the present contribution to the art may be better appreciated.

An object of the toilet foot flushing apparatus is to convert a hand-flushed toilet into a foot-flushed toilet.

Another object of the toilet foot flushing apparatus is to provide sufficient leverage for foot flushing a toilet.

A further object of the toilet foot flushing apparatus is to be easily affixed to a toilet.

An added object of the toilet foot flushing apparatus is to avoid mounting to a floor.

And, an object of the toilet foot flushing apparatus is to provide an apparatus that is fully external to an existing toilet.

A further object of the toilet foot flushing apparatus is to provide long trouble-free life.

Yet another object of the toilet foot flushing apparatus is to convert an existing hand-flushed toilet to a foot flushed toilet without the need of tools.

These together with additional objects, features and advantages of the improved toilet foot flushing apparatus will be readily apparent to those of ordinary skill in the art upon reading the following detailed description of presently preferred, but nonetheless illustrative, embodiments of the improved toilet foot flushing apparatus when taken in conjunction with the accompanying drawings.

In this respect, before explaining the current embodiments of the improved toilet foot flushing apparatus in detail, it is to be understood that the toilet foot flushing apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toilet foot flushing apparatus. It is therefore important that the claims be regarded as including such equivalent constructions insofar as they do not depart from the spirit and scope of the toilet foot flushing apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the toilet foot flushing apparatus generally designated by the reference number 10 will be described.

Figure 1:
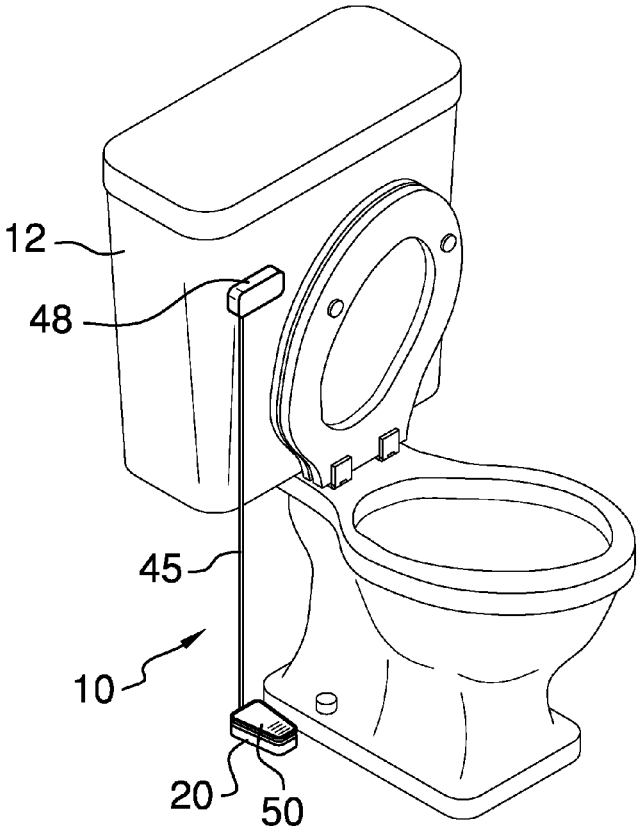
FIG. 1 is a perspective view of the installed apparatus.

Referring to FIG. 1, the apparatus 10 is partially comprised of the base 20 with pedal 50 disposed pivotally atop, the lever 48 attached to the existing toilet reservoir 12 flush mechanism, and the cable 45 connecting the base 20 to the lever 48.

Figure 2:
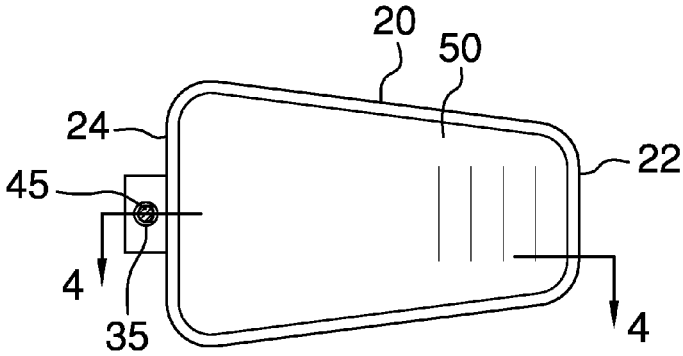
FIG. 2 is a top plan view of the base and pedal.

Referring to FIG. 2, the base 20 is wedge-shaped with the pedal 50 substantially matching that shape. The first end 22 has a smaller dimension than the spaced apart second end 24.

Figure 3:
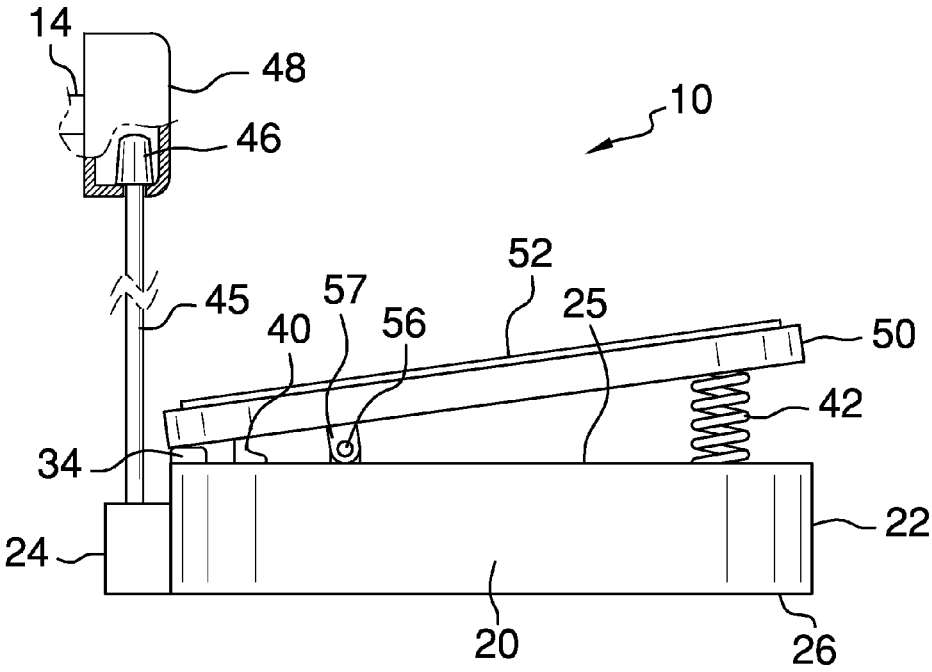
FIG. 3 is a lateral elevation view.
Figure 4:
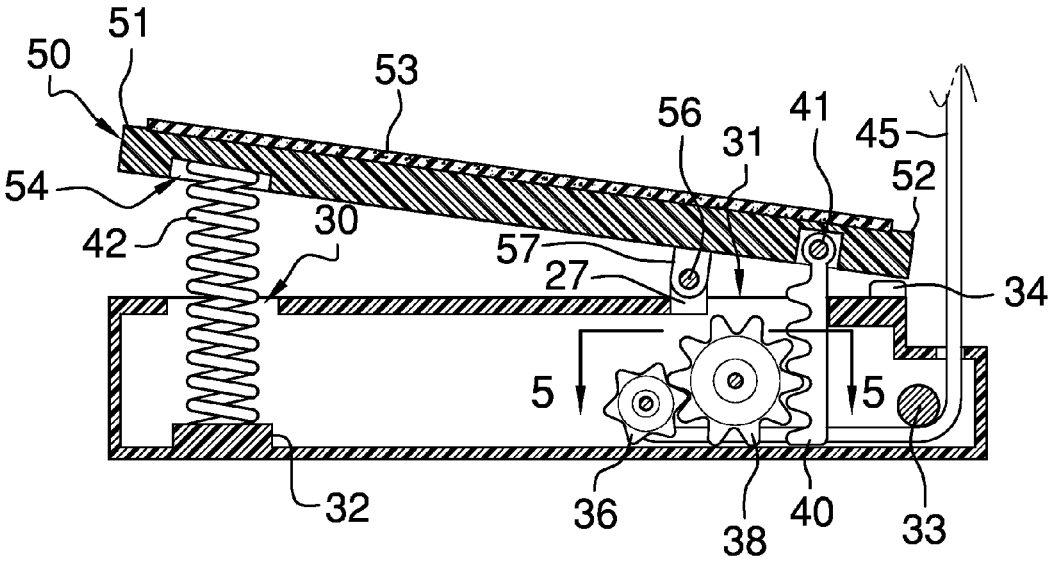
FIG. 4 is a cross sectional view of FIG. 2, taken along the line 4-4.

Referring to FIGS. 3 and 4, the base 20 top 25 is spaced apart from the bottom 26. The first opening 30 is disposed within the top 25. The first opening 30 is proximal to the first end 22. The spring pedestal 32 is disposed within the base 20 bottom 26 below the first opening 30. The second opening 31 is disposed within the base 20 top 25. The second opening 31 is more proximal to the second end 24. The pivot attachment 27 is disposed atop the base 20 top 25. The pivot attachment 27 is adjacent to the second opening 31.

Figure 5:
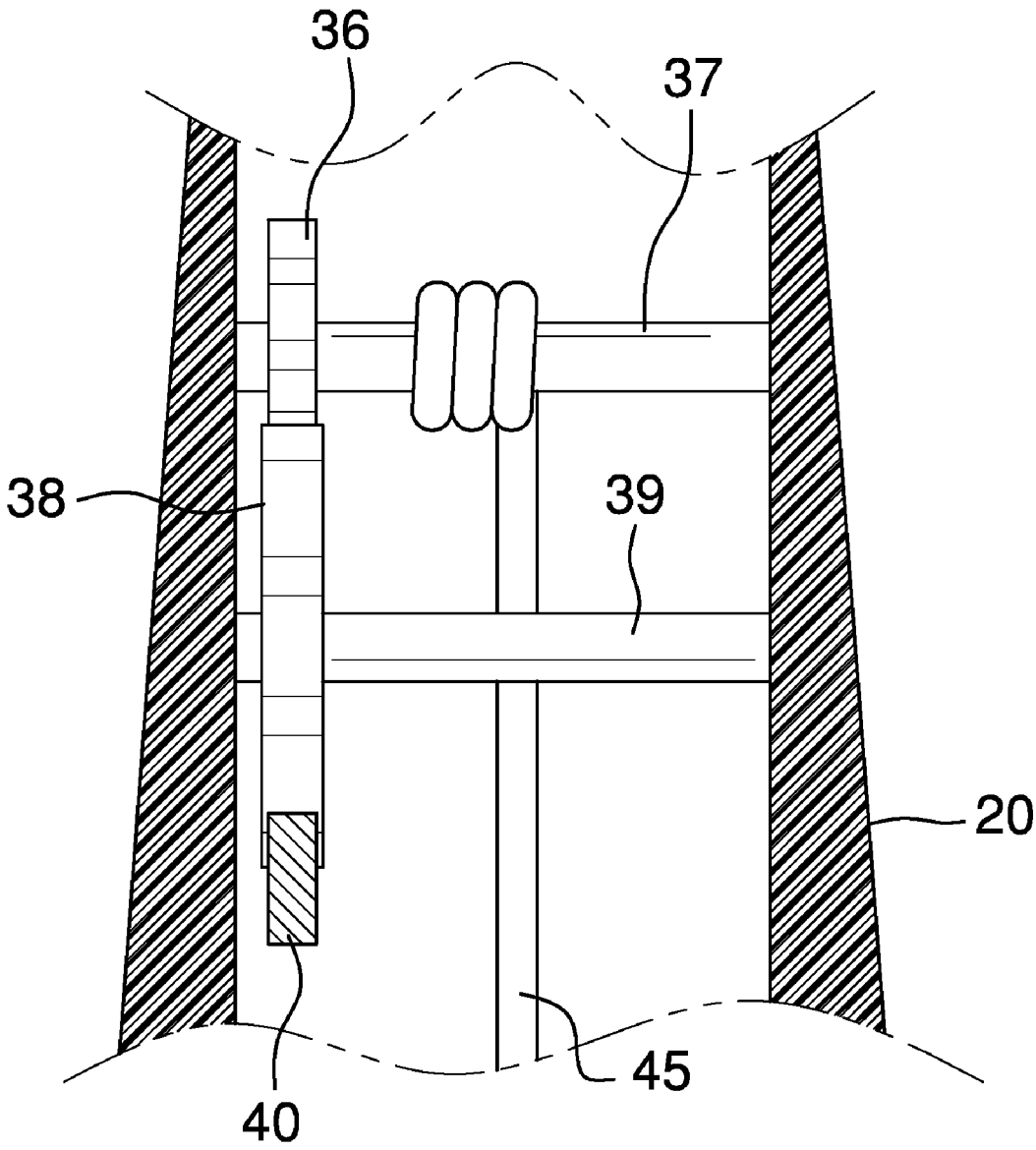
FIG. 5 is a cross sectional view of FIG. 4, taken along the line 5-5

Referring to FIG. 5, and continuing to refer to FIGS. 3 and 4, the drive gear axle 39 is disposed transversely within the base 20 below the second opening 31. The drive gear 38 is disposed on the rotatable drive gear axle 39. The spindle gear axle 37 is disposed transversely within the base 20, proximal to the drive gear axle 39. The spindle gear 36 is disposed on the rotatable spindle gear axle 37. The spindle gear 36 is engaged with the drive gear 38. The bushing 33 is disposed within the base 20 proximal to the second end 24. The cable orifice 35 is disposed above the bushing 33. The pedal 50 is disposed above the base 20. The pedal 50 has a pedal first end 51 spaced apart from a pedal second end 52. The pad 53 is disposed atop the pedal 50 and provides a cushioned frictional surface for user foot contact. The spring pocket 54 is disposed within the pedal 50 proximal to the pedal first end 51. The compression spring 42 is disposed within the spring pocket 54. The spring 42 is further disposed atop the spring pedestal 32 within the base 20. The spring 42 holds the pedal first end 51 above the base 20 first end 22 until compressed by a user's foot. The elastomeric stop 34 is disposed between the pedal second end 52 and the base 20. The stop 34 prevents excessive upward pedal 50 travel. The pedal arm 57 is extended downwardly from the pedal 50. The pedal arm 57 is pivotally connected to the pivot attachment 27 via the pedal pivot 56. The gear pivot 41 is disposed within the pedal 50 proximal to the pedal second end 52. The linear gear 40 is pivotally fastened and extended downwardly from the gear pivot 41. The linear gear 40 is engaged with the drive gear 38.

Referring to FIGS. 1 and 3, the lever 48 is attached to an existing toilet reservoir 12 flush mechanism 14. The cable 45 is adjustably attached to the lever 48 via the cable retainer 46. The cable 45 is further passed through the base 20 cable orifice 35 and around the bushing 33. The cable 45 is engaged with the spindle gear axle 37. The cable 45 is pulled by the spindle gear axle 37 upon pedal 50 depression, thereby turning the flush mechanism 14 of the toilet reservoir 12.

With respect to the above description then, it is to be realized that the optimum dimensional relationships for the parts of the toilet foot flushing apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toilet foot flushing apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toilet foot flushing apparatus may be used.

Therefore, the foregoing is considered as illustrative only of the principles of the toilet foot flushing apparatus. Further, since numerous modifications and changes will readily occur to those skilled in the art, it is not desired to limit the toilet foot flushing apparatus to the exact construction and operation shown and described, and accordingly, all suitable modifications and equivalents may be resorted to, falling within the scope of the toilet foot flushing apparatus.

What is claimed is:

1. A toilet foot flushing apparatus, comprising, in combination:

a wedge-shaped base;

a pair of engaged gears within the base, the gears comprising a spindle gear and a drive gear, a pair of axles, each axle rotationally supporting or one of the spindle and the drive gears;

a spring-repelled pedal pivotally attached to the base;

a linear gear pivotally attached to the pedal, the linear gear engaged with the drive gear;

a lever affixed to an existing flush mechanism of an existing toilet reservoir;

a cable connecting the lever to the spindle gear axle;

whereby downward pressure on the pedal, rotationally engages the spindle gear axis thereby pulling the cable, the cable thereby rotating the existing flush mechanism via the handle.

2. The apparatus according to claim 1 further comprising a frictional pad atop the pedal.

3. A toilet foot flushing apparatus, comprising, in combination:

a hollow wedge-shaped base having a first end spaced apart from a second end, the first end having a smaller dimension than the second end, a top spaced apart from a bottom;

a first opening disposed within the base top, the first opening proximal to the first end;

a spring pedestal disposed within the base bottom below the first opening;

a second opening disposed within the base top, the second opening more proximal to the second end;

a pivot attachment disposed atop the base top, the pivot attachment adjacent to the second opening;

a drive gear axle disposed transversely within the base below the second opening;

a drive gear rotationally disposed on the drive gear axle;

a spindle gear axle disposed transversely within the base, proximal to the drive gear axle;

a spindle gear disposed rotationally on the spindle gear axle, the spindle gear engaged with the drive gear;

a bushing disposed within the base proximal to the second end;

a cable orifice disposed above the bushing;

a pedal disposed above the base, the pedal having a pedal first end spaced apart from a pedal second end;

a spring pocket disposed within the pedal proximal to the pedal first end;

a compression spring disposed within the spring pocket, the spring further disposed atop the spring pedestal within the base, the spring holding the pedal first end above the base first end;

an elastomeric stop disposed between the pedal second end and the base;

a pedal arm extended downwardly from the pedal, the pedal arm pivotally connected to the pivot attachment via a pedal pivot;

a gear pivot disposed within the pedal proximal to the pedal second end;

a linear gear pivotally fastened and extended downwardly from the gear pivot, the linear gear engaged with the drive gear;

a lever attached to an existing toilet reservoir flush mechanism;

a cable adjustably attached to the lever via a cable retainer, the cable further passed through the base cable orifice and around the bushing, the cable engaged with the spindle gear axle, the cable pulled by the spindle gear axle upon pedal depression, the lever thereby turning the flush mechanism.

4. The apparatus according to claim 3 further comprising a frictional pad disposed atop the pedal.

* * * * *